United States Patent [19]

Kishida et al.

[11] Patent Number: 4,992,414

[45] Date of Patent: Feb. 12, 1991

[54] THERMAL TRANSFER RECEIVING SHEET

[75] Inventors: Seiichiro Kishida; Toshiaki Aono; Tetsu Kamosaki, all of Kanagawa, Japan

[73] Assignee: Fuji Photo Film Co., Ltd., Kanagawa, Japan

[21] Appl. No.: 413,817

[22] Filed: Sep. 28, 1989

[30] Foreign Application Priority Data

Sep. 30, 1988 [JP] Japan ..... 63-247218

[51] Int. Cl.[5] ..... B41M 5/035; B41M 5/26

[52] U.S. Cl. ..... 503/227; 8/471; 428/195; 428/342; 428/478.8; 428/513; 428/913; 428/914

[58] Field of Search ..... 8/471; 428/195, 478.2, 428/478.8, 513, 913, 914, 341, 342; 503/227

[56] References Cited

U.S. PATENT DOCUMENTS 4,720,480 1/1988 Ito et al. ..... 503/227

4,774,224 9/1988 Campbell ..... 503/227

FOREIGN PATENT DOCUMENTS 61-295085 12/1986 Japan ..... 503/227

*Primary Examiner*—Bruce H. Hess

*Attorney, Agent, or Firm*—Sughrue, Mion, Zinn, Macpeak & Seas

[57] ABSTRACT

A thermal transfer receiving sheet adapted to receiving a dye from a thermal transfer sheet containing a dye capable of being sublimed or rendered mobile by heat, wherein said thermal receiving sheet comprises at least one receiving layer for receiving dye provided on a base sheet, and said base sheet comprises a support having at least one hydrophilic binder provided on the support between the support and the receiving layer.

3 Claims, No Drawings

THERMAL TRANSFER RECEIVING SHEET

FIELD OF THE INVENTION

This invention concerns thermal transfer receiving sheets which are used in combination with thermal transfer sheets which have dye donating layers which contain dyes which are sublimed or rendered mobile by heat and, more precisely, the invention concerns thermal transfer receiving sheets with which there is little blurring or fading of the image on ageing after the image has been formed.

BACKGROUND OF THE INVENTION

Various information processing systems have been developed to meet the demands of the rapid expansion which has taken place in the information industry in recent years, and methods of recording and apparatus compatible with these information processing systems have been developed and adopted. Heat sensitive recording methods are such that the apparatus used is light and compact, there is little noise associated with the apparatus and they have excellent operability and maintenance characteristics and, since they also allow coloring to be achieved easily, these methods are the most widely used.

The heat sensitive transfer recording systems can be broadly classified into two types. In the first type, heat is imagewise applied from the support side to a thermofusible ink which has been coated onto the support and the ink is fused in the form of the pattern in which the heat has been applied and transferred to the recording medium to provide a hard copy. In the second system, heat is applied from the support side in the same way as before to a heat sensitive transfer sheet which has, on a support, a layer which contains a dye which is sublimed or rendered mobile by heat, the dye migrates into the recording medium (receiving sheet) in the form of the pattern in which the heat has been applied and a hard copy is obtained.

The recording media (thermal transfer receiving sheets) used here have a receiving layer comprising a resin which is easily dyed with dyes which receiving layer is coated on, or attached by pressure to, a base sheet such as paper or a PET base.

Among the properties required of the base sheet, it should be capable of forming an image of high density as a result of the transfer and it should provide good image storage properties with no fading of the image even on ageing after the image has been formed.

The composition of the receiving layer can be improved and the diffusibility of the dye can be increased with a view to raising the transfer density.

Furthermore, image fading arises as a result of movement in the receiving layer itself and diffusion of the dye, and if the base sheet has properties which enable the dye to diffuse, it is diffused through the base sheet and image fading occurs. It is clear that fading of the image occurs for this reason especially when polyethylene coated papers are used for the base sheet. Consequently, there is a problem in that fading of the image is liable to occur when resins which provide high dye diffusibility are used with the intention of increasing the transfer density on a polyethylene coated paper.

SUMMARY OF THE INVENTION

An object of this invention is to provide thermal transfer receiving sheets with which a high transfer density can be obtained and with which the extent of image fading is slight.

The above and other objects of this invention will be more apparent from the following description.

The objects of the invention have been achieved by means of a thermal transfer receiving sheet adapted to receiving a dye from a thermal transfer sheet containing a dye capable of being sublimed or rendered mobile by heat, wherein the thermal receiving sheet comprises at least one receiving layer for receiving dye provided on a base sheet, and the base sheet comprises a support having at least one hydrophilic binder provided on the support between the support and the receiving layer.

Moreover, thermal transfer receiving sheets in which an intermediate layer which is formed using a hydrophilic synthetic resin and/or synthetic resin aqueous emulsion is established on a synthetic paper and the receiving layer is established on this layer have been disclosed in JP-A-61-295085. (The term "JP-A" as used herein signifies an "unexamined published Japanese patent application"). However, the objective in this case is to prevent the occurrence of the disadvantages which arise when a synthetic paper is used as a support, that is to prevent curling during heating and transfer and concave type deformation in the heated parts, and the use of a comparatively large amount (3 to 20 g/m$^2$) of a water soluble synthetic resin or synthetic resin aqueous emulsion is required for this purpose. If the amount of synthetic resin aqueous emulsion used is increased in terms of the coated weight or in terms of the preferred ratio for the conjoint use of the water soluble synthetic resin and synthetic resin aqueous emulsion, there is insignificant prevention of image fading with the passage of time on storing, and if the amount of water soluble synthetic resin is increased then curl is liable to increase and problems arise in practice.

This invention is distinguished by the fact that a layer comprising as small an amount as possible of a hydrophilic binder is established in order to reduce the extent of image fading on ageing and to prevent the occurrence of curling, and this is essentially different from the invention disclosed in the aforementioned prior arts.

DETAILED DESCRIPTION OF THE INVENTION

The invention is described in detail below.

Thus, basically, the thermal transfer receiving sheets of this invention are constructed with a base sheet, an image receiving layer and a hydrophilic binder layer which is present between the base and the image receiving layer.

Examples of hydrophilic binders which can be used in the hydrophilic binder layer in this invention include vinyl polymers and derivatives thereof, such as polyvinyl alcohol, polyvinylpyrrolidone, poly(vinylpyridium) and cationic modified polyvinyl alcohol (as disclosed, e.g., in JP-A-60-145879, JP-A-60-220750, JP-A-61-143177, JP-A-61-235182, JP-A-61-245183, JP-A-61-237681 and JP-A-61-261089 incorporated herein by reference), polymers which have an acrylic group, such as polyacrylamide, polydimethylacrylamide, polydimethylaminoacrylate, polyacrylate or a salt thereof, acrylic acid/methacrylic acid copolymer or a salt thereof, polymethacrylate or a salt thereof and acrylic acid/vinyl alcohol copolymers or a salt thereof-(as disclosed, e.g., in JP-A-60-168651 and JP-A-62-9983 incorporated herein by reference), natural polymers and derivatives thereof, such as starch, oxidized starch, starch acetate, starch amine, carboxyl starch, dialdehyde starch, cationic starch, dextrin, sodium alginate, gum arabic, casein, pullulan, dextran, methylcellulose, ethylcellulose, carboxymethylcellulose, hydroxyethylcellulose and hydroxypropyl cellulose (as dosclosed, e.g., in JP-A-59-174382, JP-a-60-262685, JP-A-61-143177, JP-A-61-181679, JP-A-61-193879 and JP-A-61-287782 incorporated herein by reference), synthetic polymers such as polyethylene glycol, polypropylene glycol, polyvinyl methyl ether, maleic acid/vinyl acetate copolymers, maleic acid/N-vinylpyrrolidone copolymers, maleic acid/alkyl vinyl ether copolymers and polyethyleneimine (as disclosed, e.g. in JP-A-61-32787, JP-a-61-237680 and JP-A-61-277483 incorporated herein by reference), and the hydrophilic polymers as disclosed, e.g., in JP-A-56-58869 incorporated herein by reference.

Furthermore, the partially crosslinked hydrophilic polymers known as highly water absorbent polymers, such as starch - polyacrylonitrile hydrolyzate, starch - polyacrylic acid salt crosslinked material, carboxymethylcellulose crosslinked material, ketonized vinylacetate/methyl acrylate copolymer, and poly(sodium acrylate) crosslinked material (for example, as disclosed in "Hi-tech Polymer Materials", page 216, published 1986, Agune Publishing Co. incorporated herein by reference) can be used in the invention.

Among these, hydrophilic binders capable of being crosslinked by hardeners are preferred.

When compared with water soluble synthetic resins and synthetic resin aqueous emulsions, the use of gelatin for the hydrophilic binder has a greater effect on reducing the level of fading and, moreover, since it can be set-dried, there is very little dry tack and this is especially desirable. In practical terms, gelatins and derivatives thereof, such as lime treated gelatin, lime treated gelatin which has been subjected to a calcium removing treatment, acid treated gelatin, phthalated gelatin, acetylated gelatin and succinated gelatin, for example, and enzyme treated gelatins such as those described in *Bull. Soc. Phot. Japan*, No. 16 p.30 (1966), and gelatin hydrolyzates and enzyme degradation products, can be used for this purpose.

The amount of hydrophilic binder coated is within the range which suppresses fading of the image on ageing, and the use of as small a quantity as possible is preferred from the viewpoint of minimizing the effect on other characteristics such as curl, for example.

In practice, the amount used differs according to the type of hydrophilic binder and the type of base sheet, but of hydrophilic binder and the type of base sheet, but the use of an amount of a hydrophilic binder from 0.1 to 8 $g/m^2$ is preferred, the use of an amount of from 0.2 to 5 $g/m^2$ is more preferred, the use of an amount of from 0.4 to 3 $g/m^2$ is especially preferred, and the use of from an amount of from 0.4 to 2.5 $g/m^2$ is most preferred.

In general, image fading is seen to improve with coated weights of at least 0.1 $g/m^2$, there is a further improvement with coated weights of at least 0.2 $g/m^2$, and there is a pronounced improvement with coated weights of at least 0.4 $g/m^2$.

Furthermore, a coated weight of not more than 3 $g/m^2$ is preferred for preventing the occurrence of curl, especially when gelatin is used as the hydrophilic binder.

The hydrophilic binder layer may contain binders other than hydrophilic binders, but large amounts such that the minimizing effect on image fading is lost should not be used. In this invention it is preferred that at least 50 wt%, more preferred that at least 70 wt%, and most preferred that at least 90 wt%, of the solid fraction of the hydrophilic binder layer should consist of the hydrophilic binder.

The hydrophilic binder layer can be formed by coating on the support (base sheet) with the addition of coating promotors, viscosity increasing agents, hardeners, surfactants etc.

Examples of the hardener include those described in U.S. Pat. No. 4,678,739 (column 4,), JP-A-59-116655, JP-A-62-245216 and JP-A-61-18942. Specific examples thereof include aldehyde type hardener such as formaldehyde, aziridine type hardener, epoxy type hardener such as

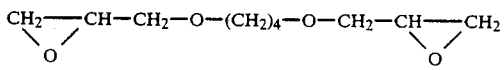

vinylsulfone type hardeners such as N,N'-ethylenebis(-vinylsulfonylacetamide)ethane, N-methylol type hardeners such as dimethylol urea, and polymer hardeners such as those described in JP-A-62-234157.

No particular limitation is imposed upon the base sheets used for the thermal transfer receiving sheets of this invention, and any of the known base sheets can be used. In the invention, materials in which the dye has a high diffusibility can also be used as base sheets.

Practical general examples are indicated below. (1) Synthetic Papers (for example polyolefin based and polystyrene based synthetic papers). (2) Paper supports, such as high grade paper, art paper, coated papers, cast coated papers, wall paper, lining paper, synthetic resin or emulsion impregnated papers, synthetic rubber latex impregnated papers, synthetic resin internally added papers, cardboard, cellulose fiber paper and polyolefin coated paper (especially papers which have been covered on both sides). (3) Various plastic films or sheets, such as polyolefin, polyvinyl chloride, polyethylene terephthalate, polystyrene, methacrylate or polycarbonate films or sheets, and films and sheets which have been treated in such a way as to impart white reflecting properties to these plastics.

Furthermore, use can also be made of laminates in which any of the sheets or plates described in (1) to (3) above are combined.

Actual examples of base sheets in which dyes have a high diffusibility include polyolefin based or polystyrene based synthetic papers, polyolefin based or polystyrene based plastic films or sheets and polyolefin coated papers (especially polyethylene coated paper).

Of these, the use of polyolefin coated paper is preferred since it has many advantages in that concave deformation due to heating does not occur during the thermal transfer process, it has excellent whiteness and it exhibits little curl. With polyolefin coated papers, the dyes are highly diffusible in the polyolefin so that fading is liable to occur, but the occurrence of fading can be prevented effectively by means of this invention.

Polyolefin coated paper (especially polyethylene coated paper) has been described, for example, on pages 223 to 240 of the Japanese Photographic Society publication entitled "Fundamentals of Photographic Engineering (Silver Salt Photography Edition)" (Published by Corona, 1979). Polyethylene coated paper consists essentially of a support sheet and a layer of polyethylene which has been coated on the surfaces of the support. The support sheet may consist of materials other than synthetic resins and high grade paper is generally used. The polyethylene coating may be established on the surface of the support sheet (core paper) using any method to attach the polyethylene layer, but such coating is usually achieved using an extrusion method. The polyethylene coating layer may be established on just the side of the support sheet on which the receiving layer is to be established or polyethylene layers may be established on both sides of the base sheet. The type of polyethylene used can be classified by density into high density polyethylene and low density polyethylene, and either type may be used. However, in consideration of the thermal insulating effect during transfer, the use of low density polyethylenes which have a lower thermal conductivity is preferred on the side on which the receiving layer is established.

No particular limitation is imposed upon the thickness of the polyethylene coating, but a thickness of from 5 to 100 μm per side is usually preferred. However, thinner polyethylene coatings (preferably from 5 to 40 μm, more preferably from 5 to 20 μm) on the receiving layer side are preferred in order to achieve higher transfer densities.

Pigments and fillers such as titanium oxide and ultramarine, for example, can be added to the polyethylene coating to increase whiteness.

Furthermore, the ethylene coated papers may have a thin gelatin layer of from some 0.05 to 0.4 g/m$^2$ established on the surface (on the side on which the receiving layer is established and/or on the reverse side). The coated weight of this gelatin layer is included in the coated weight of the hydrophilic binder of this invention.

A dye receiving layer is established as the image receiving part of the thermal transfer receiving sheet. This receiving layer takes in the dye which migrates from the thermal transfer sheet during printing and functions in such a y as to be dyed by the dye, and it preferably has a thickness of from 0.5 to 50 μm, and more preferably of from 1 to 20 μm.

Synthetic resins which can be used for the receiving layer are indicated below.

(a) Those which have Ester Bonds: For example, polyester resins, polyacrylic acid ester resins, polycarbonate resins, polyvinyl acetate resins, styrene acrylate resins and vinyltoluene acrylate resins. Actual examples have been disclosed in JP-A-59-101395, JP-A-63-7971, JP-A-7972, JP-A-63-7973 and JP-A-60-294862. Furthermore, "Vylon 290", "Vylon 200", "Vylon 280", "Vylon 300", "Vylon 103", "Vylon GK-140", and "Vylon 130" made by Toyobo Co., Ltd., and "ATR-2009" and "ATR-2010" made by Kao Corporation, for example, can be used as commercial products.

(b) Those which have Urethane Bonds: For example polyurethane resins.

(c) Those which have Amide Bonds: For example polyamides.

(d) Those which have Urea Bonds: For example urea resins.

(e) Those which have other Highly Polar Bonds: For example, polycaprolactone resins, styrene/maleic anhydride resins, poly(vinyl chloride) resins, polyacrylonitrile resins.

In addition to the synthetic resins described above it is possible to use mixtures or copolymers of these materials. Furthermore, receiving layers can be formed from two or more types of resin which have different properties.

The use of polyester resins or mixtures of resins which at least contain polyester resins is preferred for the receiving layers of this invention.

The receiving layer can be provided by coating a solution obtained by dissolving the above dye receiving polymers (synthetic resins) in an organic solvent on a base sheet followed by drying. Also, it can be provided by coating an emulsion dispersion of the dye receiving polymer in an organic solvent in an aqueous solution of water-soluble polymers, or a latex of the dye receiving polymers dispersed in an aqueous solution of water-soluble polymers on a base sheet followed by drying.

As the above water-soluble polymers, those described for the hydrophilic binders can be used. Among these, polymers capable of being crosslinked by a hardener is preferred, and gelatin and derivatives thereof and polyvinyl alcohol are more preferred.

The receiving layer may be constituted by two or more layers. In this case, the layer near the base sheet may be formed of a dye receiving polymer having a low glass transition point or added with a high boiling point solvent or a thermal solvent so as to increase the solubility to the dye, and thereby the density of the transferred image can be increased. By using, in the outermost layer, a dye receiving polymer having a higher glass transition point or containing no or a little amount of high boiling point solvents or thermal solvents, sticking or adhesion of the surface of the receiving layer to other materials, retransfer of the transferred image to other materials, and malfunctions such as blocking with the thermal transfer material can be prevented. In the case where the receiving layer has a double-layer structure, the outermost layer preferably has a thickness of from 0.1 to 2 μm, more preferably from 0.2 to 1 μm.

High transfer densities can be obtained in general when resins which have a low glass transition temperature are used, but in this case the extent of image fading on ageing after image formation is pronounced. However, this fading can be greatly reduced in extent by the incorporation of a hydrophilic binder layer of this invention and so it is possible to obtain both a high transfer density and little fading on storage using resins which have a comparatively low glass transition temperature. The effect of the invention is especially pronounced when resins which have a low glass transition temperature are used in the form of comparatively thin layers.

In this invention, known crosslinking agents can be used to crosslink the receiving layer polymers. Actual examples of crosslinking agents which can be used have been disclosed in JP-A-58-215398 and JP-A-61-199997. The use of isocyanate based crosslinking agents is especially preferred with the polyester resins.

High boiling point organic solvents or thermal solvents can be used as melting point depressants to obtain high transfer densities in this invention.

The high boiling point organic solvents are preferably solvents which are liquid at normal temperature and which do not boil at the heating temperature, and they include esters (for example, phthalate esters, phosphate esters, fatty acid esters), amides (for example aliphatic amides, sulfoamides), ethers, alcohols, paraffins and silicone oils.

Thermal solvents which can be used are compounds which (1) are compatible with dyes, (2) which are solids at normal temperatures but which melt when heated by the thermal head during printing (this may involve mixed melting with other components) and (3) which do not decompose on being heated by the thermal head. The preferred compounds have a melting point of 35° to 250° C., and preferably of from 35° to 200° C., and a value for the ratio (inorganic nature/organic nature) of less than 1.5. Here, inorganic nature and organic nature are factors which provide an indication of the nature of the compound, and this has been described in detail, for example, in "The Realms of Chemistry", vol. 11, page 719, (1957). In practical terms, the compounds disclosed in JP-A-62-136646 can be used for this purpose.

The high boiling point organic solvents and/or thermal solvents can be present individually in the form of a microdispersion in the accepting layer, or they may be present in the form of a suitable mixture with other components such a binders.

The above mentioned high boiling point solvents can also be used to improve slip properties, adhesion resistance, peeling properties and the curl balance, for example.

Furthermore, fillers such as silica, clay, talc, diatomaceous earth, calcium carbonate, calcium sulfate, barium sulfate, aluminum silicate, synthetic zeolites, zinc oxide, lithophone and titanium white, for example, may also be added to the receiving layer or an underlayer.

Release agents can be included in the receiving layer, or a releases agent layer can be established over the receiving layer, in order to improve the peelability of the thermal transfer sheet from the thermal transfer receiving sheet of this invention. Release agents which can be used for this purpose include, for example, solid waxes such as polyethylene wax and amide wax, teflon powder, fluorine based and phosphate ester based surfactants and silicon oils, and the use of silicone oils is especially desirable.

Liquid silicone oils can be used for this purpose but the use of curable oils is preferred. From among the silicone oils, the use of modified silicone oils is preferred. Actual examples include amino modified silicone oils such as KF-393, KF-857, KF-858 and X-22-3680, X-22-3801, epoxy modified silicone oils such as KF-1001, KF-101, KF-103 and X-60-164, catalytically or photocurable silicone oils such as KS-705F-OS (catalytic), KS705F-PS-1 (catalytic), KS720, KS770-PL-3 (catalytic) and KS774-PL-3 all made by Shin-etsu Chemical Co., Ltd. Among these materials the use of the amino modified silicone oils is especially preferred.

The thickness of the release agent layer is from 0.01 to 5 μm, and preferably from 0.05 to 2 μm. The release agent layer may be coated by adding silicone oil to the receiving layer and then curling the silicone oil which subsequently bleeds out of the surface of the receiving layer.

In this invention, further anti-color fading agents can also be included in the receiving layers described above. The anti-color fading agents may be included in the receiving layer by addition to, or by dispersion or dissolution in, the coating composition used for forming the receiving layer. Examples of anti-color fading agents include antioxidants, ultraviolet absorbers and various metal complexes. Examples of antioxidants include chroman based compounds, coumarane based compounds, phenol based compounds (for example hindered phenols), hydroquinone derivatives, hindered amine derivatives and spiroindane derivatives. The compounds disclosed in JP-A-61-159644 are also effective in this connection.

Examples of ultraviolet absorbers include benzotriazole based compounds (for example, U.S. Pat. No. 3,533,794), 4-thiazolidone based compounds (for example, U.S. Pat. No. 2,252,681), benzophenone based compounds (for example, JP-A-46-2784), and the other compounds disclosed, for example, in JP-A-54-48535, JP-A-62-136641 and JP-A-61-88256. Furthermore, the ultraviolet absorbing polymers disclosed in JP-A-62-260152 are also effective for this purpose.

Examples of metal complexes include the compounds disclosed, for example, in U.S. Pat. No. 4,241,155, columns 3 to 36 of U.S. Pat. No. 4,245,018, columns 3 to 8 of U.S. Pat. No. 4,254,195, JP-A-62-174741, pages 27 to 29 of JP-A-61-88256, JP-A-1-77045 and JP-A-63-199248. Examples of useful anti-color fading agents have been disclosed on pages 125 to 137 of JP-A-62-215272.

The above mentioned antioxidants, ultraviolet absorbers and metal complexes may be used in combinations.

Moreover, fluorescent whiteners can be included in the receiving layers described earlier in this invention. The compounds described, for example, by K. Veenkatataman in "The Chemistry of Synthetic Dyes", volume 5, chapter 8, and those disclosed in JP-A-61-143752 can be cited as examples of fluorescent whiteners include stilbene based compounds, coumarin based compounds, biphenyl based compounds, benzoxazolyl based compounds, naphthylimide based compounds, pyrazoline based compounds, carbostyril based compounds and 2,5-dibenzoxazolylthiophene based compounds. The fluorescent whiteners can be used in combination with anti-color fading agents.

The thermal transfer receiving sheets of this invention may have intermediate layers which do not contain a hydrophilic binder between the base sheet and the receiving layer. However, if an intermediate layer which does not contain a hydrophilic binder s such that dyes have a high diffusibility in the layer, it is necessary to provide a hydrophilic binder layer between this intermediate layer and the receiving layer. In cases where the intermediate layer which does not contain hydrophilic binder is such that dyes do not have a high diffusibility within the layer, the hydrophilic binder layer may be located between the intermediate layer and the base sheet or it may be located between the intermediate layer and the receiving layer. Here, whether or not a dye has a high diffusibility is determined by establishing the intermediate layer which does not contain hydrophilic binder as described above in an embodiment in which there is no hydrophilic binder layer and deciding whether or not the extent of fading of a transfer image (fading on ageing under conditions of 80° C. for 3 days or 60° C. for 1 week) is greater than that observed when no such layer has been established.

Intermediate layers which do not contain hydrophilic binders include either cushioning layers or porous layers, depending on the material from which they are constituted. Resins which are satisfactory under the conditions described above include, for example, polyurethane resins, polyester resins, polybutadiene resins, polyacrylic acid ester resins, epoxy resins, polyamide resins, rosin modified phenolic resins, terpene/phenol resins and ethylene/vinyl acetate copolymer resins.

One, or mixtures of two or more, of the above mentioned resins can be used.

The following methods may be used to form porous layers: (1) Methods in which a liquid consisting of an emulsion of a synthetic resin, such as polyurethane for example, or a synthetic rubber latex, such as a methyl methacrylate/butadiene based synthetic rubber emulsion, which has been agitated mechanically to incorporate bubbles is coated onto a base sheet and dried. (2) Methods in which a liquid obtained by mixing a foaming agent with the above mentioned synthetic resin emulsions or synthetic rubber latexes is coated onto the base sheet and dried. (3) Methods in which a liquid obtained by mixing a foaming agent with a vinyl chloride plastisol, a synthetic resin such as polyurethane or a synthetic rubber such as a styrene/butadiene based synthetic rubber is coated onto a base sheet and foamed by heating. (4) Methods in which a liquid mixture consisting of a solution obtained by dissolving a thermoplastic resin or a synthetic rubber in an organic solvent and an inorganic solvent (including those consisting principally of water) which is less volatile than the said organic solvent and compatible with the said organic solvent, and in which the thermoplastic resin or synthetic rubber is not soluble, is coated onto the base sheet and dried, whereupon a microporous layer is formed.

The intermediate layers which do not contain hydrophilic binder may be established on both sides in cases where receiving layers are present on both sides of the base sheet, or on just one side of the base sheet.

The thickness of an intermediate layer which does not contain hydrophilic binder is from 0.5 to 50 μm, and most desirably from 2 to 20 μm.

An anti-static agent can be included in the receiving layer on at least one side, or at the surface of the receiving layer, of a thermal transfer receiving sheet of this invention. Examples of anti-static agents include surfactants, for example cationic surfactants (quaternary ammonium salts, polyamine derivatives etc.), anionic surfactants (alkylsulfonates etc.), amphoteric type surfactants and non-ionic surfactants, and also metal oxides such as aluminum oxide and tin oxide etc. In structures in which a receiving layer is only established on one surface, an anti-static agent may also be used on the opposite surface to that on which the receiving layer is established.

The thermal transfer receiving sheets of this invention are used in combination with thermal transfer sheets.

A thermal transfer sheet has essentially, on a base sheet, a thermal transfer layer (dye donating layer) which contains a binder and dye which sublimes or becomes mobile on the application of heat. Thermal transfer sheets are obtained by preparing a coating solution in which the well known dyes which sublime or become mobile on the application of heat are dissolved or dispersed in an appropriate solvent and coating this liquid onto one side of a base sheet of the type well known for use in thermal transfer sheets at a rate such as to provide a dry film thickness of some 0.2 to 5 μm, and preferably of from 0.4 to 2 μm, and drying to form a thermal transfer layer.

Furthermore, anti-static layers as disclosed, for example, in EP 194106A and slip layers as disclosed, for example, in JP-A-62-51490 can be established, as required.

Dyes which are useful for forming thermal transfer layers of this type include all of those dyes which have been used in thermal transfer sheets in the past, but the use of dyes of low molecular weight, i.e., 150 to 180, is especially desirable in this invention, and the dyes are selected in consideration of their transfer temperature, hue, light resistance and their solubility or diffusibility in inks and binder resins, etc.

In practical terms, examples of such dyes include disperse dyes, basic dyes and oil soluble dyes, and examples of actual dyes which can be used include "Sumicron Yellow E4GL", "Dyanics Yellow H2G-FS", "Miketone Polyether Yellow 3GSL", "Kayaset Yellow 937", "Sumicron Red EFBL", "Dyanics Red ACE", "Miketone Polyether Red FB", "Kayaset Red 126", "Miketone Fast Brilliant Blue B", and "Kayaset Blue 136".

Furthermore, use can be made of the yellow dyes disclosed, for example, in JP-A-59-78895, JP-A-60-28451, JP-A-60-28453, JP-A-60-53564, JP-A-61-148096, JP-A-60-239290, JP-A-60-31565, JP-A-60-30393, JP-A-60-53565, JP-A-60-27954, JP-A-61-262191, JP-A-152563, JP-A-61-244595, JP-A-62-196186, JP-A-63-142062, JP-A-63-39380, JP-A-62-290583, JP-A-63-11094, JP-A-63-111095, JP-A-63-122954, JP-A-63-71392, JP-A-63-74685, JP-A-63-74688 and U.S. patent application Ser. No. 318,871 filed on Mar. 6, 1989 (dyes which can be represented by the general formula indicated below.

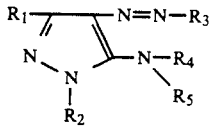

In this formula, $R^1$ represents a hydrogen atom, an alkyl group, an alkoxy group, an aryl group, an alkoxycarbonyl group, a cyano group or a carbamoyl group, $R_2$ represents a hydrogen atom, an alkyl group or an aryl group, $R_3$ represents an aryl group or a heterocyclic group, and $R_4$ and $R_5$ may be the same or different, each representing a hydrogen atom or an alkyl group. Moreover, the above mentioned substituent groups may be further substituted.).

Use can also be made of the magenta dyes disclosed, for example, in JP-A-60-223862, JP-A-60-28452, JP-A-60-31563, JP-A-59-78896, JP-A-60-31564, JP-A-60-303391, JP-A-61-227092, JP-A-61-227091, JP-A-60-30392, JP-A-60-30694, JP-A-60-131293, JP- A-61-227093, JP-A-60-159091, JP-A-61-262190, JP-A-62-33688, JP- A-63-5992, JP-A-61-12392, JP-A-62-55194, JP-A-62-297593, JP-A63-74685, JP-A-63-74688, JP-A-62-97886, JP-A-62-132685, JP-A61-163895, JP-A-62-211190, JP-A-62-99195 and GB-A-2209341 (dyes of the general formula indicated below.

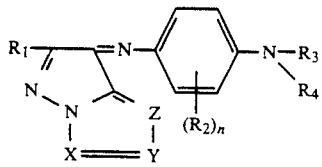

In this formula, $R_1$ and $R_2$ represents hydrogen atoms, halogen atoms, alkyl groups, cycloalkyl groups, alkoxy groups, aryl groups, aryloxy groups, aralkyl groups, cyano groups, acylamino groups, sulfonylamino groups, alkoxycabonyl groups, carbamoyl groups, sulfamoyl groups, sulfonyl groups, acyl groups or amino groups, and $R_3$ and $R_4$ represent alkyl groups, cycloalkyl groups, aralkyl groups or aryl groups. $R_3$ and $R_4$ may also be joined together to form a ring, and rings may also be formed by $R_2$ and $R_3$, and by $R_2$ and $R_4$. Moreover, n represents an integer of $$-\overset{R_5}{\overset{|}{C}}= \text{ groups}$$

value from 0 to 3. X, Y and Z represent T,0260 or nitrogen atoms. (Here, $R^5$ represents a hydrogen atom, an alkyl group, a cycloalkyl group, an aralkyl group, an aryl group, an alkoxy group, an aryloxy group or an amino group.) Furthermore, when X and Y or Y and Z are $$-\overset{R_5}{\overset{|}{C}}= \text{ groups}$$

they may be joined together to form saturated or unsaturated carbocyclic rings. The substituent groups indicated above may be further substituted.).

Use can also be made of the cyan dyes disclosed, for example, in JP-A-59-78894, JP-A-59-227490, 60-151098, JP-A-59-227493, JP-A-61-244594, JP-A-59-117948, JP-A-60-131292, JP-A-60-172591, JP-A-60-151097, JP-A-60-131294, JP-A-60-217-266, JP-A-60-31559, JP-A-60-53563, JP-A-61-255897, JP-A-60-239289, JP-A-61-22993, JP-A-61-19396, JP-A-61-368493, JP-A-61-35994, JP-A-61-31467, JP-A-61-148269, JP-A-61-49893, JP-A-61-57651, JP-A-60-23291, JP-A-60-239292, JP-A-61-284489, JP-A-62-191191, JP-A-62-138291, JP-A-62-288656, JP-A-63-57293, JP-A-63-15853, JP-A-63-144089,.JP-A-63-15790, JP-A-62-311190, JP-A-63-74685, JP-A-63-74688, JP-A-62-132684, JP-A-62-87393, JP-A-62-255187 and U.S. patent application Ser. No. 218,789 filed on July 14, 1988 (dyes of the general formula indicated below.

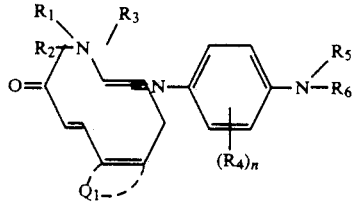

In this formula, $Q_1$ represents a group of atoms, including at lat one nitrogen atom, which is required to form, together with the carbon atoms to which they are bound, a nitrogen containing heterocyclic ring which incorporates at least five atoms, $R_1$ represents an acyl group or a sulfonyl group, $R_2$ represents a hydrogen atom or an aliphatic group which has from 1 to 6 carbon atoms, $R_3$ represents a hydrogen atom or a halogen atom, an alkoxy group or an aliphatic group which has from 1 to 6 carbon atoms, $R_4$ represents a halogen atom, an alkoxy group or an aliphatic group which has from 1 to 6 carbon atoms, and n represents an integer of value 0 to 4. $R_3$ may be joined to $R_1$ or $R_2$ or $R_4$ to form a ring. $R_5$ and $R_6$ represent hydrogen atoms, aliphatic groups which have from 1 to 6 carbon atoms, or aromatic groups. $R_5$ and $R_6$ may also be joined together to form a ring. Furthermore, $R_5$ and/or $R_6$ may be joined with $R_4$ to form rings.).

Furthermore all of the well known binder resins used for this purpose in the past can be used as the binder resins which are used together with the dyes described above, and the binder resin is usually selected to provide a high resistance to heat and properties such that the migration of the dye is not impeded when it is heated. For example, use can be made of polyamide based resins, polyester based resins, epoxy based resins, polyurethane based resins, polyacrylic resins (for example, polymethyl methacrylate, polyacrylamide, polystyrene-2-acrylonitrile), vinyl based polymers, polyvinylpyrrolidone, polyvinyl chloride based resins (for example, vinyl chloride/vinyl acetate copolymers), polycarbonate based resins, polystyrene, polyphenylene oxide, cellulose based resins (for example, methylcellulose, ethylcellulose, carboxymethylcellulose, cellulose acetate hydrogen phthalate, cellulose acetate, cellulose acetate propionate, cellulose acetate butyrate, cellulose triacetate), polyvinyl alcohol based resins (for example, polyvinyl alcohol and partially saponified polyvinyl alcohol such as polyvinyl butyral, petroleum based resins, rosin derivatives, coumarone/indene resins, terpene based resins and polyolefin based resins (for example, polyethylene, polypropylene).

Binder resins of this type are preferably used at a rate, for example, of from about 80 to 600 parts by weight per 100 parts by weight of dye.

In this invention, the ink solvents known in the past can be used freely a ink solvents for the dissolution or dispersion of the above mentioned dyes and binder resins. Actual examples include alcohols such a methanol, ethanol, isopropyl alcohol, butanol and isobutanol, ketones such as methyl ethyl ketone, methyl isobutyl ketone and cyclohexanone, aromatic solvents such as toluene and xylene, halogenated solvents such as dichloromethane and trichloroethane, dioxane, and tetrahydrofuran, and mixtures of these solvents can also be used. These solvents must be selected and used in accordance with providing the prescribed concentration of the dye which is being used and providing for a satisfactory dissolution or dispersion of the binder resin. For example, the use of an amount of solvent about 9 to 20 times the total amount of dye and binder resin is desirable.

The thermal transfer sheets obtained in the way described above are contacted or laminated with the thermal transfer receiving sheets of this invention and heated in accordance with an image signal by means of a heating device such as a thermal head, for example, from either side, but preferably from the reverse side of the thermal transfer sheet. As a result of heating, the dye in the thermal transfer sheet can be moved and transferred in accordance with the magnitude of the thermal energy applied, simply and with comparatively low energy, to the thermal transfer receiving sheet, and it is possible to obtain color images which have excellent sharpness and resolution.

Any of base sheets known in the art can be used for the base sheet of the thermal transfer sheet which is used in this invention. For example, the base sheets may consist of polyester (for example polyethylene terephthalate), polyamide, polycarbonate, glassine paper, condenser paper, cellulose ester, fluoropolymer, polyether, polyacetal, polyolefin, polyimide, polyphenylene sulfide, polypropylene, polysulfone or cellophane.

The base sheet used for the thermal transfer sheet is generally of thickness from 2 to 30 μm. The sheets may be covered with an under-layer, as required. Furthermore, the reverse side may be coated with a slipping layer in order to prevent the thermal head from sticking to the base sheet. Slipping layers of this type consist of lubricating substances, such as surfactants, liquid lubricants, solid lubricants or mixtures of these materials, and the layers may or may not contain a polymer binder.

Preferred embodiments of the invention are indicated below.

(a) Thermal transfer receiving sheets as disclosed in wherein the hydrophilic binder of the hydrophilic binder layer is gelatin.

(b) Thermal transfer receiving sheets wherein the coated weight of gelatin is from 0.4 to 3 g/m$^2$.

(c) Thermal transfer receiving sheets wherein the base sheet is a polyolefin coated paper.

The invention is described in more detail below by means of illustrative examples.

EXAMPLE 1

Preparation of the Thermal Transfer Sheet (A)

A polyester film (Lumirror, made by Toray Co., Ltd.) of thickness 4.5 μm which had a heat resistant slip film consisting of thermoset acrylic resin established on one side was used as a base and thermal transfer receiving sheet (A) was obtained by coating a thermal transfer layer forming ink of which the composition is indicated below in such a way as to provide a coated weight after drying of 1 g/m$^2$ on the opposite surface of the base to that on which the heat resistant slip layer had been established.

| Magenta Ink Composition for Thermal Transfer Layer | |
|---|---|
| Dispersed Dye (Disperse Red 60, MS Red G, made by Mitsui Toatsu Chemicals, Inc.) | 3.6 parts |
| Dispersed Dye (Disperse Violet 26, Macrolex Violet R, made by Bayer AG) | 2.4 parts |
| Polyvinyl butyrate Resin (Eslec BX-I, made by Sekisui Chemicals Co, Ltd.) | 4.3 parts |
| Methyl ethyl ketone | 45 parts |
| Toluene | 45 parts |

Preparation of the Thermal Transfer Receiving Sheet

Low density polyethylene which had been milled with titanium oxide and ultramarine was laminated onto one side of a top quality paper as a base sheet and the other side was laminated with high density polyethylene. The low density polyethylene laminated side of this polyethylene coated paper was then coated with the hydrophilic binder layer composition (1) as shown in table 1.

| Hydrophilic Binder Layer Composition (1) | |
|---|---|
| Gelatin | 60 grams |
| Water | 3,000 grams |
| Surfactant | 2.3 grams |
| $C_4H_9CH(C_2H_5)OCOCH_2$ | |
| $\vert$ | |
| $C_4H_9CH(C_2H_5)OCOCH-SO_3Na$ | |
| Viscosity increasing agent (Poly(potassium styrenesulfonate)) | 1.4 grams |

Moreover, the receiving Layer coating composition (2) of which the composition is indicated below was coated by wire bar coating over the hydrophilic binder layer to provide a dry film thickness of 10μ, and the transfer receiving sheets (1) to (4) were obtained in this way.

Drying was accomplished by natural drying in a dry atmosphere followed by oven drying at 100° C. for a period of 30 minutes.

| Receiving Layer Coating Composition (2) | |
|---|---|
| Polyester Resin (Vylon 280, made by Toyobo Co., Ltd.) | 14 grams |
| Isocyanate Based Curing Agent (KP-90, made by Dainippon Ink and Chemicals Co., Ltd.) | 3 grams |
| Amino-modified Silicone Oil (KF-857, made by Shin-etsu Silicone Co., Ltd.) | 0.5 gram |
| Epoxy-modified Silicone Oil (KF-100T, made by Shin-etsu Silicone Co., Ltd.) | 0.5 gram |
| Triphenyl phosphate | 6 grams |
| Methyl ethyl ketone | 85 ml |
| Toluene | 85 ml |
| Cyclohexanone | 30 ml |

Moreover, the thermal transfer sheet and the thermal transfer receiving sheets obtained in the ways indicated above were laminated together in such a way that the thermal transfer layer was in contact with the receiving layer and printing was carried out using a thermal head from the support side of the thermal transfer sheet under conditions of a thermal head output 0.25 W/dot, a pulse width 0.2 to 15 msec, dot density 6 dots/mm, and the magenta dye dyed the receiving layer of the thermal transfer receiving layer.

Next, the thermal transfer receiving sheet was stored for 1 week in the dark at 80° C. and fading of the image in the dyed parts was investigated. Furthermore, the extent of curl of thermal transfer receiving sheets after aging for 5 hours under conditions of 25° C., 10% RH was also investigated. The results obtained are shown in Table 1.

Moreover, in Table 1, the evaluation of fading was made using three categories, namely A: Virtually no fading observed at all, B: Slight fading observed, and C: Pronounced fading.

The extent of curl wa evaluated by the following manner. The receiving sheet having a dimension of 10 *cm* × 12 *cm* was placed on a flat plate in such a manner that the concave of the sheet was made upward. The extent of curl was evaluated by the distance between the corner of the receiving sheet and the surface of the flat plate. (+) means that the receiving layer was made downward, and (−) means that the receiving layer was made upward when the concave of the sheet was made upward.

TABLE 1

| Number of receiving sheet | Coated weight of hydrophilic binder layer composition (g/m$^2$) | Fading | Curl (mm) |
|---|---|---|---|
| 1 (Comparison) | 0 | C | −5 |
| 2 (Comparison) | 0.05 | C | −5 |
| 3 (Invention) | 0.15 | B | −5 |
| 4 (Invention) | 0.3 | A | −5 |
| 5 (Invention) | 1.0 | A | −4 |
| 6 (Invention) | 1.5 | A | −3 |
| 7 (Invention) | 2.0 | A | +3 |
| 8 (Invention) | 3.0 | A | +15 |
| 9 (Invention) | 4.0 | A | +28 |

TABLE 1-continued

| Number of receiving sheet | Coated weight of hydrophilic binder layer composition ($g/m^2$) | Fading | Curl (mm) |
|---|---|---|---|
| 10 (Invention) | 6.0 | A | +35 |

It is clear from Table 1 that the thermal transfer receiving sheets of this invention exhibited little fading on ageing after image formation, and that they were not liable to curling when the coated weight is 3 $g/m^2$ or less.

EXAMPLE 2

Thermal transfer receiving sheets 21 to 25 were prepared in the same way as the thermal transfer receiving sheets in Example 1 except that the hydrophilic binder layer composition (1) was replaced by the hydrophilic binder layer composition (3) indicated below, and the receiving layer coating composition (2) was replaced by the receiving layer coating composition (4) indicated below, and the thermal transfer receiving sheets were evaluated in the same way as in Example 1.

| Hydrophilic Binder Layer Composition (3) | |
|---|---|
| Gelatin | 60 grams |
| Water | 3,000 grams |
| Surfactant | 2.3 grams |
| $C_4H_2CH(C_2H_5)OCOCH_2$ \| $C_4H_2CH(C_2H_5)OCOCH-SO_2Na$ | |
| Viscosity Increasing Agent $(NH_2CH{=}CHSO_2CH_2CONHCH_2-)_2$ | 1.8 grams |

| Receiving Layer Coating Composition (4) | |
|---|---|
| Polyester Resin (Vylon 300, made by Toyobo Co., Ltd.) | 20 grams |
| Isocyanate based Curing Agent (KP-90, made by Dainippon Ink and Chemicals Co., Ltd.) | 3 grams |
| Amino-modified silicone Oil (KF-857, made by Shin-etsu Silicone Co., Ltd.) | 0.5 gram |
| Epoxy-modified Silicone Oil (kf-100t, made by Shin-etsu Silicone Co., Ltd.) | 0.5 gram |
| Methyl ethyl ketone | 100 ml |
| Toluene | 100 ml |

The results obtained are shown in Table 2.

TABLE 2

| Number of receiving sheet | Coated wt. of hydrophilic binder layer composition ($g/m^2$) | Fading | Curl |
|---|---|---|---|
| 21 (composition) | 0 | C | −5 |
| 22 (Invention) | 0.3 | A | −5 |
| 23 (Invention) | 1 | A | −3 |
| 24 (Invention) | 3 | A | +10 |
| 25 (Invention) | 4 | A | +24 |

It is clear from Table 2 that the thermal transfer receiving sheets of this invention exhibited little fading on ageing after image formation, and that they were not liable to curling. However, the curling properties clearly became poorer as the coated weight of hydrophilic binder layer was increased.

EXAMPLE 3

Thermal transfer receiving sheets 31 to 34 were prepared in the same way as in Example 1 except that the hydrophilic binder layer was modified to (5) indicated below, and the samples were evaluated in the same way as before.

| Hydrophilic Binder Layer Composition (5) | |
|---|---|
| Hydrophilic Binder (see Table 3) | 60 grams |
| Water | 3,000 grams |
| Surfactant | 2.3 grams |
| $C_4H_9CH(C_2H_5)OCOCH_2$ \| $C_4H_9CH(C_2H_5)OCOCH-SO_3Na$ | |

The results obtained are shown in Table 3.

TABLE 3

| Number of receiving sheet | Hydrophilic binder | Coated wt. ($g/m^2$) | Fading |
|---|---|---|---|
| 31 (Comparison) | None | 0 | C |
| 32 (Invention) | Hydroxyethyl-cellulose | 1 | B |
| 33 (Invention) | Polyacrylamide | 1 | B |
| 34 (Invention) | Poly(vinyl alcohol) | 1 | B–A |

It is clear from Table 3 that the establishment of a hydrophilic binder layer provided an improvement in respect of image fading.

EXAMPLE 4

Thermal transfer receiving sheets 41 to 43 were prepared in the same way except that synthetic paper (YUPO-FPG-150: Made by Oji Yuka K.K.) was used for the base sheet instead of the polyethylene coated paper used in Example 1, and the samples so obtained were evaluated in the same way as before. The results obtained are shown in Table 4.

TABLE 4

| Number of receiving sheet | Coated wt. of hydrophilic binder layer composition ($g/m^2$) | Fading |
|---|---|---|
| 41 (Comparison) | 0 | C–B |
| 42 (Invention) | 0.1 | B |
| 43 (Invention) | 1 | A |

It is clear that when synthetic paper is used, the establishment of a hydrophilic binder layer of this invention provides an improvement in respect of image fading. Moreover, with all of samples 14 to 17, concave deformation of the thermally printed parts occurred as a result of the heat applied during image formation.

EXAMPLE 5

Preparation of the Thermal Transfer Receiving Sheet

In the gelatin solution (A) having the following composition, the organic solvent solution of the dye receiving polymer (B) was dispersed and emulsified by a homogenizer.

| Gelatin solution (A) | |
|---|---|
| Gelatin | 2.3 g |
| 5%-aqueous solution of sodium dodecylbenzenesulfonate | 20 ml |
| Water | 80 ml |

| Solution of the dye receiving polymer (B) | |
|---|---|
| Polyester resin (Vylon 300, made by Toyobo Co., Ltd.) | 7.0 g |
| Carboxy-modified silicone oil (X-22-3710, made by Shin-etsu Silicone, Co. Ltd.) | 0.7 g |
| Methyl ethyl ketone | 20 ml |
| Toluene | 10 ml |
| Triphenylphosphate | 1.5 g |

Into the above-prepared composition, a solution obtained by dissolving 0.5 g of the following fluorine surface active agent in 10 ml of a mixed solvent of water/methanol (1/1) and 25 ml of 4%-aqueous solution of the following hardener were added so as to prepare a coating composition for the receiving layer.

Fluorine surface active agent $$C_3F_7SO_2\underset{\underset{C_3H_7}{|}}{N}CH_2COOK$$

Hardener $$\begin{array}{l} CH_2NHCOCH_2SO_2CH{=}CH_2 \\ | \\ CH_2NHCOCH_2SO_2CH{=}CH_2 \end{array}$$

The composition was coated on a polyethylene laminated paper of which surface had been corona-discharge treated by a wire bar coating method to a wet thickness of 75 μm followed by drying so as to obtain a receiving sheet 501.

Furthermore, receiving sheets 502 to 507 were prepared in the same manner as in the receiving sheet 501 except that a gelatin subbing layer having a thickness shown in Table 5 was provided.

The above-prepared receiving sheets 501 to 507 were printed by using the thermal transfer material in Example 1 in the same manner as in Example 1.

The transferred images on the receiving sheets 501 to 507 were uniform and had excellent S/N ratios, and the densities thereof were from 1.5 to 1.6. These receiving sheets were stored for one week in the dark at 70° C. and fading of the image in the dyed parts was investigated. Furthermore, the extent of curl of receiving sheets after aging overnight at 25° C. 10% RH was also investigated. The results obtained are shown in Table 5. The evaluations for the results in Table 5 were the same as in Example 1.

TABLE 5

| Number receiving sheet | | Coated weight of hydrophilic binder layer composition ($g/m^2$) | Fading | Curl (mm) |
|---|---|---|---|---|
| 501 | (Comparison) | 0 | B–C | −5 |
| 502 | (Invention) | 0.1 | B | −5 |
| 503 | (Invention) | 0.5 | A | −5 |
| 504 | (Invention) | 1.0 | A | −4 |
| 505 | (Invention) | 2.0 | A | −1 |
| 506 | (Invention) | 4.0 | A | +19 |
| 507 | (Invention) | 10.0 | A | +30 |

It is clear from the results in Table 5 that the thermal transfer receiving sheets of this invention exhibited little fading on aging after image formation. Particularly, when the coated amount of gelatin in the hydrophilic binder layer was 0.4 $g/m^2$ or more, the receiving sheets exhibited substantially no fading, while the extent of curl was increased when the coated amount of gelatin in the hydrophilic binder layer was 3 $g/m^2$ or more.

EXAMPLE 6

The thermal transfer receiving sheets 601 to 608 having the constitution shown in Tables 6 and 7 were prepared. The gelatin dispersion of polyester resin was prepared in the same manner as in Example 1. In Table 6, the coated amounts are indicated in terms of $g/m^2$.

By using the thermal transfer sheets (VY-S100, made by Hitachi Co., Ltd.) and the above prepared thermal transfer receiving sheets 601 to 608, thermal transfer printing was carried out using a color video printer (VY-100, made by Hitachi Co., Ltd.) at a dot density of 6 dots/mm.

The recorded signals for printing was video images which had continuous gradation having clear edges from low density areas to high density areas.

The transferred images obtained on these receiving sheets had good S/N ratios and smooth continuous gradation. These receiving sheets were evaluated for fading and extent of curl in the same manner as in Example 6. The results obtained are shown in Table 7.

TABLE 6

| | |
|---|---|
| Third Layer | |
| Gelatin | 0.1 |
| Polyester resin (Vylon 290: made by Toyobo Co., Ltd.) | 0.4 |
| Second Layer | |
| Gelatin | 1.3 |
| Polyester resin (Vylon 300: made by Toyobo Co., Ltd.) | 4 |
| Surfactant (1) | 0.5 |
| Silicone oil (X-22-3710, made by Toray Silicone Co, Ltd.) | 0.4 |
| Diphenyl phthalate | 1.0 |
| First Layer | |
| Gelatin | Shown in Table 7 |
| Support | |
| Polyethylene laminated paper | |
| Front surface: | Polyethylene layer containing $TiO_2$ (thickness: 10 μm) |
| Core paper: | Ordinary paper (150 $g/m^2$) |
| Back surface: | Polyethylene layer (thickness: 20 μm) |

Surfactant (1)

Sodium dodecylbenzenesulfonate

Surfactant (2)

$$C_8H_{17}SO_2\underset{\underset{C_3H_7}{|}}{N}CH_2COOK$$

Hardener (1)

$$\begin{array}{l} CH_2NHCOCH_2SO_2CH{=}CH_2 \\ | \\ CH_2NHCOCH_2SO_2CH{=}CH_2 \end{array}$$

Additionally, surfactant (1), surfactant (2) and hardener (1) were added to the third layer.

TABLE 7

| Number receiving sheet | | Coated weight of hydrophilic binder layer composition ($g/m^2$) | Fading | Curl (mm) |
|---|---|---|---|---|
| 601 | (Comparison) | 0 | B–C | −5 |
| 602 | (Invention) | 0.2 | B | −5 |
| 603 | (Invention) | 0.5 | A | −5 |
| 604 | (Invention) | 1.0 | A | −4 |

TABLE 7-continued

| Number receiving sheet | | Coated weight of hydrophilic binder layer composition ($g/m^2$) | Fading | Curl (mm) |
|---|---|---|---|---|
| 605 | (Invention) | 2.0 | A | +1 |
| 606 | (Invention) | 4.0 | A | +16 |
| 607 | (Invention) | 8.0 | A | +31 |
| 608 | (Invention) | 16.0 | A | +32 |

It is clear from the results in Table 7 that the thermal transfer receiving sheets of this invention exhibited little fading on aging after image formation. Particularly, when the coated amount of gelatin in the hydrophilic binder layer was 0.4 $g/m^2$ or more, the receiving sheets exhibited substantially no fading, while the extent of curl was increased when the coated amount of gelatin in the hydrophilic binder layer was 3 $g/m^2$ or more.

EXAMPLE 7

Thermal transfer receiving sheets 701 to 707 were prepared in the same manner as in the preparation of receiving sheets 501 to 507 except that the following receiving layer coating composition was used.

Receiving Layer Coating Composition 20 g of polyester resin (Vylon 290, made by Toyobo Co., Ltd.) and 2 g of diphenyl phthalate were dissolved in 30 ml of toluene and 70 ml of methyl ethyl ketone. The solution obtained was dispersed and emulsified in 100 ml of water containing 0.25 g of sodium dodecylbenzenesulfonate using a homogenizer at 15,000 rpm for 10 minutes. 5 cc of the solution of fluorine surface active agent used in Example 5 was added to the above emulsion to prepare the receiving layer coating composition.

The thermal transfer receiving sheets 701 to 707 were evaluated in the same manner as in Example 5. The results obtained are shown in Table 8 below.

TABLE 8

| Number receiving sheet | | Coated weight of hydrophilic binder layer composition ($g/m^2$) | Fading | Curl (mm) |
|---|---|---|---|---|
| 701 | (Comparison) | 0 | C | −5 |
| 702 | (Invention) | 0.1 | B | −5 |
| 703 | (Invention) | 0.5 | A | −4 |
| 704 | (Invention) | 1.0 | A | −3 |
| 705 | (Invention) | 2.0 | A | −2 |
| 706 | (Invention) | 4.0 | A | +15 |
| 707 | (Invention) | 10.0 | A | +35 |

It is clear from the results in Table 8 that the thermal transfer receiving sheets of this invention exhibited little fading on aging after image formation. Particularly, when the coated amount of gelatin in the hydrophilic binder layer was 0.4 $g/m^2$ or more, the receiving sheets exhibited substantially no fading, while the extent of curl was increased when the coated amount of gelatin in the hydrophilic binder layer was 3 $g/m^2$ or more.

While the invention has been described in detail and with reference to specific examples thereof, it will be apparent to one skilled in the art that various changes and modifications can be made therein without departing from the spirit and scope thereof.

What is claimed is:

1. A thermal transfer receiving sheet adapted to receiving a dye from a thermal transfer sheet containing a dye capable of being sublimed or rendered mobile by heat, wherein said thermal receiving sheet comprises at least one receiving layer for receiving dye provided on a base sheet, and said base sheet comprises a support having at least one hydrophilic binder provided on the support between the support and the receiving layer, wherein said hydrophilic binder is gelatin.

2. A thermal transfer receiving sheet as in claim 1, wherein the amount of said hydrophilic binder is from 0.4 to 3 $g/m^2$.

3. A thermal transfer receiving sheet as in claim 1, wherein said base sheet is a polyethylene coated paper.

* * * * *